US011408194B2

(12) United States Patent
Landwehr, IV

(10) Patent No.: US 11,408,194 B2
(45) Date of Patent: Aug. 9, 2022

(54) POST SUPPORT SLEEVE

(71) Applicant: Herbert M. Landwehr, IV, Sharon, KS (US)

(72) Inventor: Herbert M. Landwehr, IV, Sharon, KS (US)

( * ) Notice: Subject to any disclaimer, the term of this patent is extended or adjusted under 35 U.S.C. 154(b) by 0 days.

(21) Appl. No.: 16/820,924

(22) Filed: Mar. 17, 2020

(65) Prior Publication Data

US 2020/0217099 A1 Jul. 9, 2020

Related U.S. Application Data

(60) Provisional application No. 62/833,151, filed on Apr. 12, 2019.

(51) Int. Cl.
*E04H 12/22* (2006.01)
*E01F 9/685* (2016.01)

(52) U.S. Cl.
CPC ..... *E04H 12/2269* (2013.01); *E01F 9/685* (2016.02); *E04H 12/2276* (2013.01); *E04H 12/2215* (2013.01)

(58) Field of Classification Search
CPC ..... E04H 12/2269; E04H 12/2276; E04H 12/2215; E04H 12/2223; E04H 17/22; E01F 9/685; E01F 9/0175; E01F 9/0117
See application file for complete search history.

(56) References Cited

U.S. PATENT DOCUMENTS 2,455,641 A * 12/1948 Badeau ..... H01R 4/66 174/6
2,477,981 A * 8/1949 Havery ..... A47G 33/12 248/527
4,269,010 A 5/1981 Glass
4,926,592 A * 5/1990 Nehls ..... E01F 9/681 40/607.05
5,165,663 A 11/1992 Wells
5,365,694 A * 11/1994 Macaluso ..... E01F 13/046 49/131
5,782,040 A * 7/1998 McCartan ..... E01F 9/635 52/302.5
5,984,587 A 11/1999 Odle
7,722,014 B2 * 5/2010 Godwin ..... E04H 12/2261 52/297
7,919,711 B2 * 4/2011 Crutcher ..... E04H 12/2215 174/6
8,317,226 B1 * 11/2012 Wong ..... E04H 12/2261 280/769
8,888,413 B2 * 11/2014 Seider ..... E02D 5/56 405/250
9,238,922 B2 * 1/2016 Intagliata ..... E04H 12/347
10,083,557 B1 * 9/2018 Heisler, Jr. ..... G08B 13/08
(Continued)

*Primary Examiner* — Edwin J Toledo-Duran
(74) *Attorney, Agent, or Firm* — Boudwin Intellectual Property; Daniel Boudwin

(57) ABSTRACT

A post support sleeve is shown and described. The post support sleeve includes a housing having a base and at least one sidewall. The housing has an interior volume and an open top end. The open top end is proportioned to fit various sized posts therein. The at least one sidewall has at least one aperture located therethrough. The at least one aperture is positioned to have a fastener placed therein. The base further has a plurality of drain apertures therethrough.

1 Claim, 2 Drawing Sheets

(56) References Cited

U.S. PATENT DOCUMENTS

| | | | | |
|---|---|---|---|---|
| 2003/0205006 | A1* | 11/2003 | Conner | E01F 9/635 52/98 |
| 2006/0239764 | A1 | 10/2006 | Salman | |
| 2007/0170412 | A1 | 7/2007 | Lee | |
| 2007/0235616 | A1* | 10/2007 | Gross | E04H 12/2261 248/346.5 |
| 2009/0133337 | A1 | 5/2009 | Hill | |
| 2009/0250673 | A1* | 10/2009 | Menzel | E04H 12/2215 242/372 |
| 2010/0171085 | A1* | 7/2010 | Webster, IV | E04G 21/3223 256/65.14 |
| 2015/0090857 | A1* | 4/2015 | Walker | E04H 12/2238 248/535 |
| 2017/0138070 | A1* | 5/2017 | Subzda | E04G 21/3276 |
| 2017/0159256 | A1* | 6/2017 | Li | E02D 5/24 |
| 2018/0066448 | A1* | 3/2018 | Cavanagh | E04H 17/163 |
| 2020/0242870 | A1* | 7/2020 | Heisler, Jr. | G08B 13/08 |
| 2021/0246683 | A1* | 8/2021 | Smith | E04H 17/22 |

* cited by examiner

POST SUPPORT SLEEVE

CROSS REFERENCE TO RELATED APPLICATIONS

This application claims the benefit of U.S. Provisional Application No. 62/833,151 filed on Apr. 12, 2019. The above identified patent application is herein incorporated by reference in its entirety to provide continuity of disclosure.

BACKGROUND OF THE INVENTION

The present invention relates to setting and replacing posts. More particularly, the present invention provides a sleeve that is secured into the ground and has a post to be positioned within the sleeve.

Traditionally, when installing a post there is a multiple step process. First, a hole must be dug to the correct depth, often between 24 and 36 inches deep. Then, sediment must be placed at the bottom of the hole and leveled out. Third, a post is placed into the hole and leveled. Finally, a filler is placed in the hole around the post. Often times this filler is a cement or concrete product.

When a post needs to be replaced after being installed using this traditional process it becomes a time consuming and labor-intensive process. The post and filler must be pulled out of the ground. This requires the surrounding ground to be removed then the post and filler material to be removed. Often times the filler material weighs several hundred pounds. This means that removing the post with the filler attached often requires heavy machinery. Once the old post and filler material is removed the entire process of setting a new post must begin again.

Consequently, there is a need for an improvement in the art of setting and replacing posts. The present invention substantially diverges in design elements from the known art while at the same time solves a problem many people face when having to set or replace a post. In this regard the present invention substantially fulfills these needs.

SUMMARY OF THE INVENTION

The present invention provides a post support sleeve wherein the same can be utilized for providing convenience for the user when setting or replacing a post. The post support sleeve is comprised of a housing having a base and at least one sidewall. The housing has an interior volume and an open top end, wherein the open top end is configured to accept a post. The at least one sidewall has at least one aperture located therethrough, wherein the at least one aperture is configured to accept a fastener therein.

Another object of the present invention is to provide a housing having a rectangular cross section.

Another object of the present invention is to provide a housing having a round cross section.

Another object of the present invention is to have the at least one aperture within the at least one sidewall is a threaded aperture.

Another object of the present invention is to provide a base having a plurality of apertures located therethrough.

Another object of the present invention is to provide a bolt for a fastener.

Another object of the present invention is to have a plurality of apertures located on a lower section of the at least one sidewall.

Another object of the present invention is to provide a housing made of aluminum.

Another object of the present invention is to provide a housing made from anodized steel.

Another object of the present invention is to provide traction nubs protruding from the base of the post support sleeve.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 4 shows a perspective view of an embodiment of the post support sleeve in a hole prior to being filled in.

FIG. 5 shows a perspective view of an embodiment of the post support sleeve in a hole after being filled in.

DETAILED DESCRIPTION OF THE INVENTION

Figure 1:
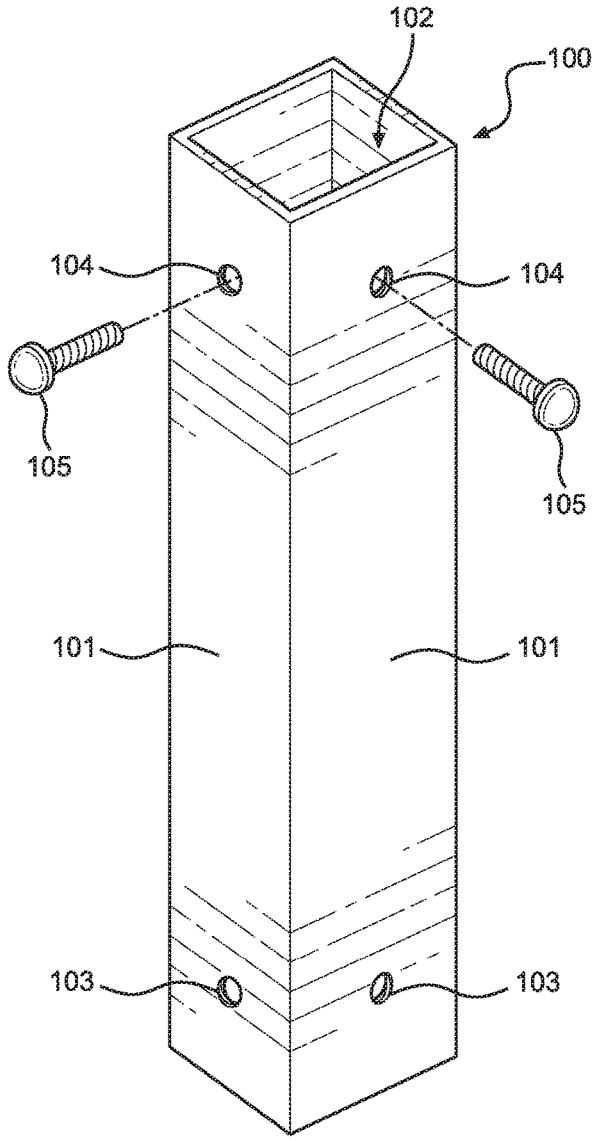
FIG. 1 shows a perspective view of an embodiment of the post support sleeve in a rectangular configuration.

Reference is made herein to the attached drawings. Like reference numerals are used throughout the drawings to depict like or similar elements of the post support sleeve. For the purposes of presenting a brief and clear description of the present invention, a preferred embodiment will be discussed as used for the post support sleeve. The figures are intended for representative purposes only and should not be considered to be limiting in any respect.

Referring now to FIG. 1, there is shown a perspective view of an embodiment of the post support sleeve in a rectangular configuration. The post support sleeve 100 includes a base as described in FIG. 3. The base has at least one sidewall 101 rising therefrom. In the shown embodiment there are four sidewalls 101. The shown embodiment further has a rectangular cross section. Specifically, the cross section is a square cross section however any rectangular shape is envisioned by this disclosure.

The at least one sidewall 101 and the base form an interior volume. The post support 100 sleeve has an open top end 102. The interior volume and the open top end 102 are configured to accept a post therein. In one embodiment the post support sleeve 100 is proportioned to fit flush with the post. In another embodiment the post support sleeve 100 is larger than the post.

In one embodiment there are a plurality of apertures 103 located toward a lower section of the at least one sidewall 101. The plurality of apertures 103 function as drain holes and will allow fluids to exit the post support sleeve 100. This will prevent rusting of the device and rotting of the post.

In one embodiment the post support sleeve 100 further includes a plurality of securement apertures 104 located at a top section of the at least one sidewall 101. The plurality of securement apertures 104 are configured to accept a fastener 105 therethrough. In one embodiment the plurality of securement apertures 104 have a smooth interior. In another embodiment the plurality of securement apertures 104 have a threaded interior. In this embodiment the fastener 105 is configured to be secured within the aperture via the threading.

Figure 2:
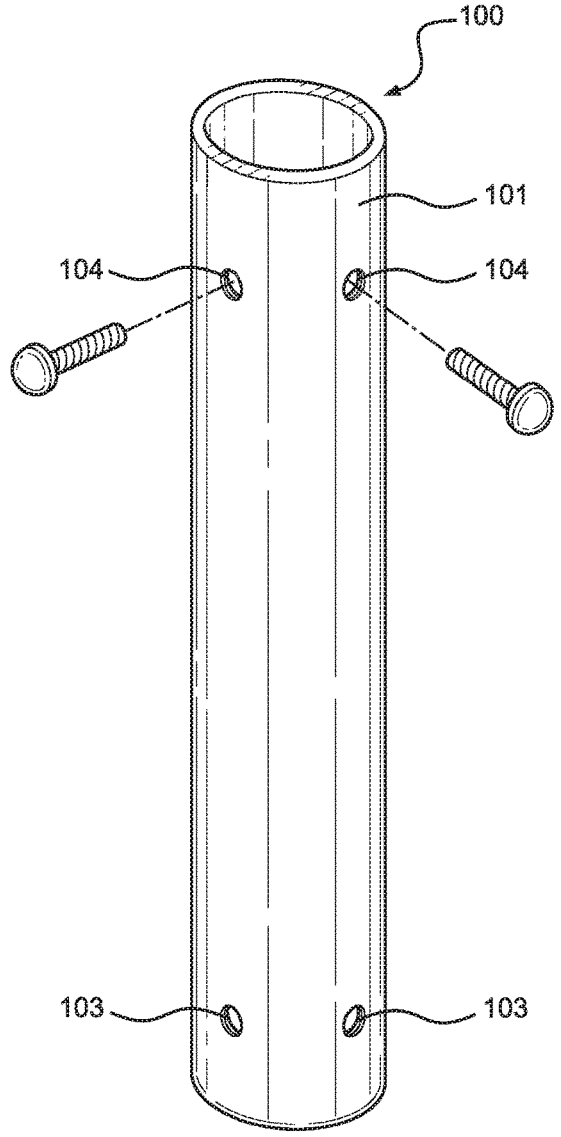
FIG. 2 shows a perspective view of an embodiment of the post support sleeve in a rounded configuration.

Referring now to FIG. 2, there is shown a perspective view of an embodiment of the post support sleeve in a round configuration. In the shown embodiment the post support sleeve 100 has a rounded cross section. Specifically, the cross-section is circular. However, other shapes such as an oval shape are also envisioned by this disclosure. The shown embodiment is still comprised of a base as described in FIG. 3 and at least one sidewall 101. The sidewall 101 has a plurality of apertures 103 on the lower portion thereof. Further, the at least one sidewall 101 has a plurality of securement apertures 104 located at a top section of the at least one sidewall 101 as described above.

In one embodiment the base and the at least one sidewall 101 are made from aluminum. Aluminum will keep the device light weight. Aluminum is further resistant to rust and corrosion. In another embodiment the base and at least one sidewall 101 are made from steel. In one embodiment the steel is anodized. This will prevent the steel from rusting or corroding.

Figure 3:
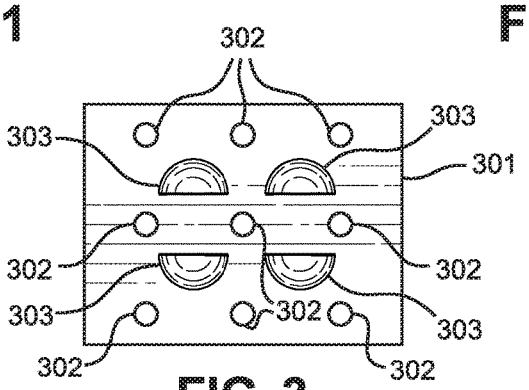
FIG. 3 shows a bottom up view of an embodiment of the post support sleeve.

Referring now to FIG. 3, there is shown a bottom up view of an embodiment of the post support sleeve. The base 301 of the post support sleeve is configured to fit any shape of the sleeve. In one embodiment the base 301 is proportioned to fit flush with the at least one sidewall. In another embodiment the base 301 will overhang the at least one sidewall.

In one embodiment the base 301 has a plurality of drain apertures 302 located therein. The plurality of drain apertures 302 serve a dual purpose. First, the plurality of drain apertures 302 serve as drain holes. This will allow water or other liquids to drain from the post support sleeve. Second, the plurality of drain apertures 302 will serve to apply extra friction to the base 301 to prevent movement. See below for a further description of this feature.

In one embodiment there is a plurality of traction nubs 303 protruding from the exterior side of the base 301. The traction nubs 303 will help to better secure the base 301 when it is placed within a hole. In one embodiment the traction nubs will interact with sediment as described below in FIG. 4. In the shown embodiment the traction nubs 303 are semi-spheres. In other embodiments other shapes may be used.

Figure 4:
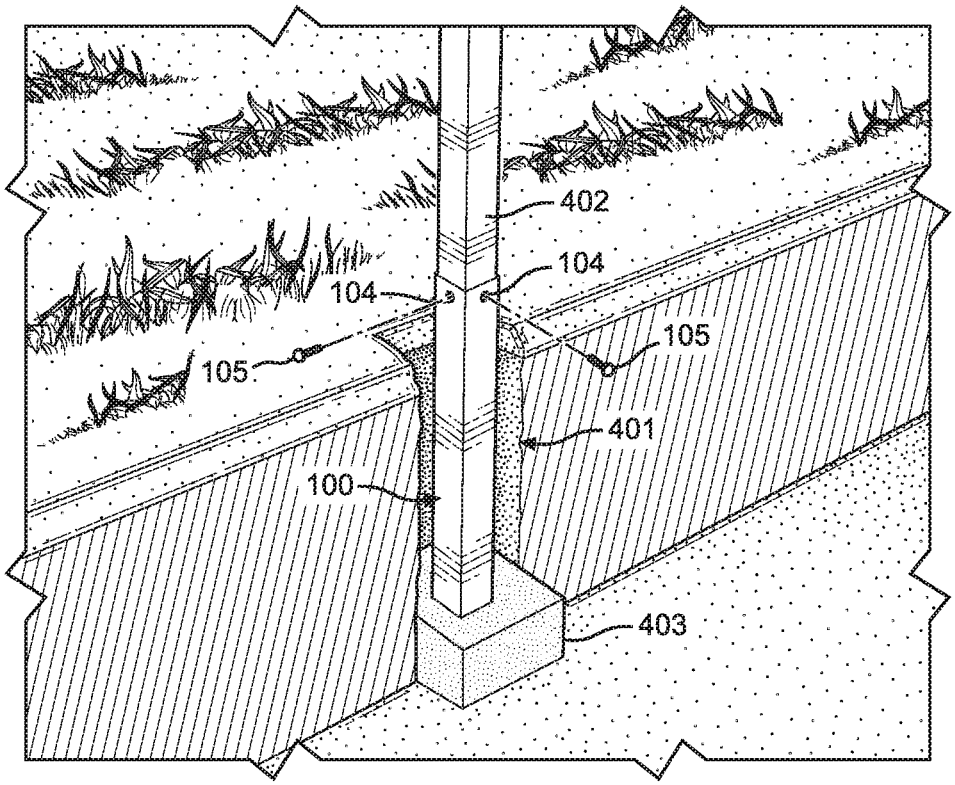

Referring now to FIG. 4, there is shown a perspective view of an embodiment of a post within the post support sleeve secured with fasteners, within a hole prior to the hole being filled in. The process begins by inserting the post 402 into the post support sleeve 100. Fasteners 105 are then placed into the securement apertures to hold the post in place. After the post 402 is placed within the post support sleeve 100 a hole 401 is dug where a post 402 will need to be placed.

A sediment 403 is then placed in the bottom of the hole 401. In one embodiment the sediment 403 is a sand. In one embodiment the hole 401 is 24 inches deep. In another embodiment the hole 401 is 36 inches deep. In other embodiments the post support sleeve 100 may be of other required sizes. In other embodiment a post hole 401 is of different dimension. The post support sleeve 100 is then placed within the hole. At this time the traction nubs located in the base will engage the sediment 403. This will apply extra support and better hold the post support sleeve 100 in place. Once the sediment is placed followed by the post support sleeve 100, the post 402 and the post support sleeve 100 are leveled vertically and aligned with a string line.

The post support sleeve 100 is configured to have the top of the at least one sidewall 101 be positioned above the ground when placed within the hole 401. This will expose the securement apertures 104.

Figure 5:
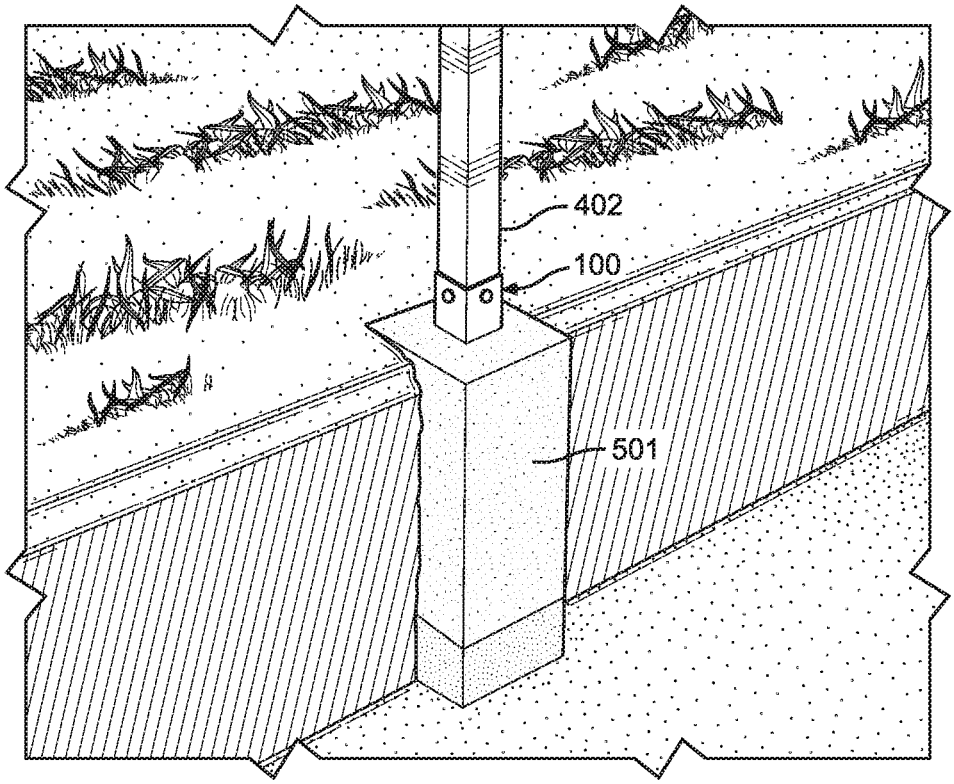

Referring now to FIG. 5, there is shown a perspective view of an embodiment of the post support sleeve in a hole after being filled in. Once the post support sleeve is positioned in the desired location within the post hole 401, a filler material 501 is placed therein. The filler material 501 will hold the post support sleeve 100 in place within the ground.

When replacing the post 402 while using the post support sleeve 100, the post support sleeve 100 will remain in the ground surrounded by the filler material 501. The fasteners 105 will be removed followed by the post 402. A new post will be placed into the post support sleeve 100 followed by the fasteners 105. The post will then be replaced and held in place without the need to remove and replace the filler material 501.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A post support sleeve, consisting of:

a housing having a planar base and at least one sidewall extending from an upper side of the planar base about a perimeter thereof;

the housing has an interior volume and an open top end disposed opposite the planar base, wherein the open top end is configured to accept a fence post;

the at least one sidewall has at least one aperture located therethrough, wherein the at least one aperture is configured to accept a fastener therein;

a plurality of semispherical traction nubs affixed to a lower side of the planar base;

a plurality of drain apertures disposed on the lower side of the planar base in a grid pattern within a boundary defined by the at least one sidewall;

wherein each semispherical traction nub of the plurality of traction nubs is positioned within a single cell of the grid pattern of the plurality of drain apertures within the boundary defined by the at least one sidewall;

each single cell of the grid pattern formed by four of the plurality of drain apertures; and wherein the post support sleeve is proportioned to receive a fence post therein.

* * * * *